US008936246B2

(12) United States Patent
Frazin

(10) Patent No.: US 8,936,246 B2
(45) Date of Patent: Jan. 20, 2015

(54) MULTI-ACTION POKER GAME AND METHOD OF CONDUCTING MULTIPLE HANDS SUBSTANTIALLY SIMULTANEOUSLY

(75) Inventor: Timothy M. Frazin, Dallas, TX (US)

(73) Assignee: Pac Gaming LLC, Dallas, TX (US)

( * ) Notice: Subject to any disclaimer, the term of this patent is extended or adjusted under 35 U.S.C. 154(b) by 0 days.

(21) Appl. No.: 13/416,250

(22) Filed: Mar. 9, 2012

(65) Prior Publication Data

US 2013/0234391 A1 Sep. 12, 2013

(51) Int. Cl.
*A63F 1/00* (2006.01)

(52) U.S. Cl.
USPC ..... 273/292; 273/295; 463/13

(58) Field of Classification Search
CPC ..... A63F 1/00; G07F 17/3293
USPC ..... 273/292; 463/14, 143
See application file for complete search history.

(56) References Cited

U.S. PATENT DOCUMENTS

| | | | | |
|---|---|---|---|---|
| 4,041,880 | A | 8/1977 | Schankman | |
| 5,356,140 | A | 10/1994 | Dabrowski et al. | |
| 5,895,047 | A | 4/1999 | Callahan | |
| 6,986,514 | B2 | 1/2006 | Snow | |
| 7,306,516 | B2 | 12/2007 | Losilevsky | |
| 7,407,163 | B2 | 8/2008 | Snow | |
| 7,744,452 | B2 | 6/2010 | Cimring et al. | |
| 7,764,836 | B2 | 7/2010 | Downs et al. | |
| 7,775,887 | B2 | 8/2010 | Kuhn et al. | |
| 7,976,372 | B2 | 7/2011 | Baerlocher et al. | |
| 8,087,983 | B2 | 1/2012 | Longway | |
| 8,142,271 | B2 | 3/2012 | Kuhn et al. | |
| 8,150,157 | B2 | 4/2012 | Downs et al. | |
| 8,177,628 | B2 | 5/2012 | Manning et al. | |
| 8,251,801 | B2 | 8/2012 | Wadds et al. | |
| 8,262,450 | B1 | 9/2012 | Lubin | |
| 8,287,386 | B2 | 10/2012 | Miller et al. | |
| 8,342,526 | B1 | 1/2013 | Sampson et al. | |
| 8,342,549 | B1 | 1/2013 | Vey | |
| 8,360,844 | B2 | 1/2013 | Schwartz et al. | |
| 2002/0017758 | A1* | 2/2002 | Buono et al. | 273/292 |
| 2007/0045957 | A1 | 3/2007 | Blair | |
| 2007/0241502 | A1 | 10/2007 | Campbell et al. | |
| 2008/0194308 | A1 | 8/2008 | Falciglia | |
| 2009/0029756 | A1 | 1/2009 | Guest | |
| 2010/0001467 | A1* | 1/2010 | Behrendsen et al. | 273/292 |
| 2011/0105224 | A1 | 5/2011 | Hartmann | |

FOREIGN PATENT DOCUMENTS

| | | |
|---|---|---|
| JP | 2008/526389 | 7/2008 |
| KR | 10/2002/0043487 | 6/2002 |
| WO | WO2005/087331 | 9/2005 |

* cited by examiner

*Primary Examiner* — Michael Dennis
(74) *Attorney, Agent, or Firm* — Greenberg Traurig

(57) ABSTRACT

Simultaneous poker hands played on an elliptical, table incorporating two dealer stations with each dealer station including one or more of the following: automatic shuffler; chip rack and chips; poker cards; and drop box. Using the table facilitates the play of a game comprising broadly: positioning two dealers about a table at two independent dealer stations, each dealer station including one or more of the following: (i) automatic card shuffler; (ii) chip rack and chips; (iii) poker cards; and (iv) drop box; utilizing said two dealers to deal independent poker hands substantially simultaneously; and providing players with two distinctive chip sets to play said independent poker hands substantially simultaneously.

14 Claims, 6 Drawing Sheets

MULTI-ACTION POKER GAME AND METHOD OF CONDUCTING MULTIPLE HANDS SUBSTANTIALLY SIMULTANEOUSLY

FIELD OF THE INVENTION

The embodiments of the present invention relate to a poker game utilizing a table configured to accommodate two dealers for conducting a multi-action poker game using two decks of cards whereby independent hands are being played substantially simultaneously.

BACKGROUND

The popularity of poker has exploded over the last ten years. As a result, purses and tournament fields have increased dramatically along with the desire to play cash games. Despite its popularity, poker can be tedious during down time or cold runs of cards, especially for players craving action. The down time or cold run of cards can last for ten or more hands consecutively over a 15-20 minute period of time or more. Also, for younger players raised on fast pasted video games, traditional poker does not provide enough sensory stimulation to maximize engagement.

Thus, it would be advantageous to develop a new poker game to reduce the down time for players and increase playing action, thereby maintaining a high level of interest.

SUMMARY

The embodiments of the present invention are directed to a multi-action poker game played on a poker table incorporating two dealer stations with each dealer station including one or more of the following: automatic card shuffler; chip rack and chips; poker cards; and drop box as described in U.S. patent application Ser. No. 13/416,347, now U.S. Pat. No. 8,827,271, which is incorporated herein for all purposes. Using the poker table facilitates the play of a poker game comprising broadly: positioning two dealers about a poker table at two independent dealer stations, each dealer station including one or more of the following: (i) automatic card shuffler; (ii) chip rack and chips; (iii) poker cards; and (iv) drop box; utilizing said two dealers to deal independent poker hands substantially simultaneously; and providing poker players with two distinctive poker chip sets to play said independent poker hands substantially simultaneously.

Another embodiment includes a method of conducting a poker game comprising: utilizing two dealers at a poker table to deal and manage independent poker hands substantially simultaneously, said two dealers using independent and distinguishable: (i) poker cards; and (ii) poker chips.

Another embodiment includes poker game system comprising: a poker table having two independent dealer stations; two independent and distinguishable decks of cards; two independent and distinguishable chip sets; and wherein a dealer at each dealer station deals and manages an independent hand substantially simultaneously using said two independent and distinguishable decks of cards and said two independent and distinguishable chip sets.

Other variations, embodiments and features of the present invention will become evident from the following detailed description, drawings and claims.

DETAILED DESCRIPTION

Figure 1:
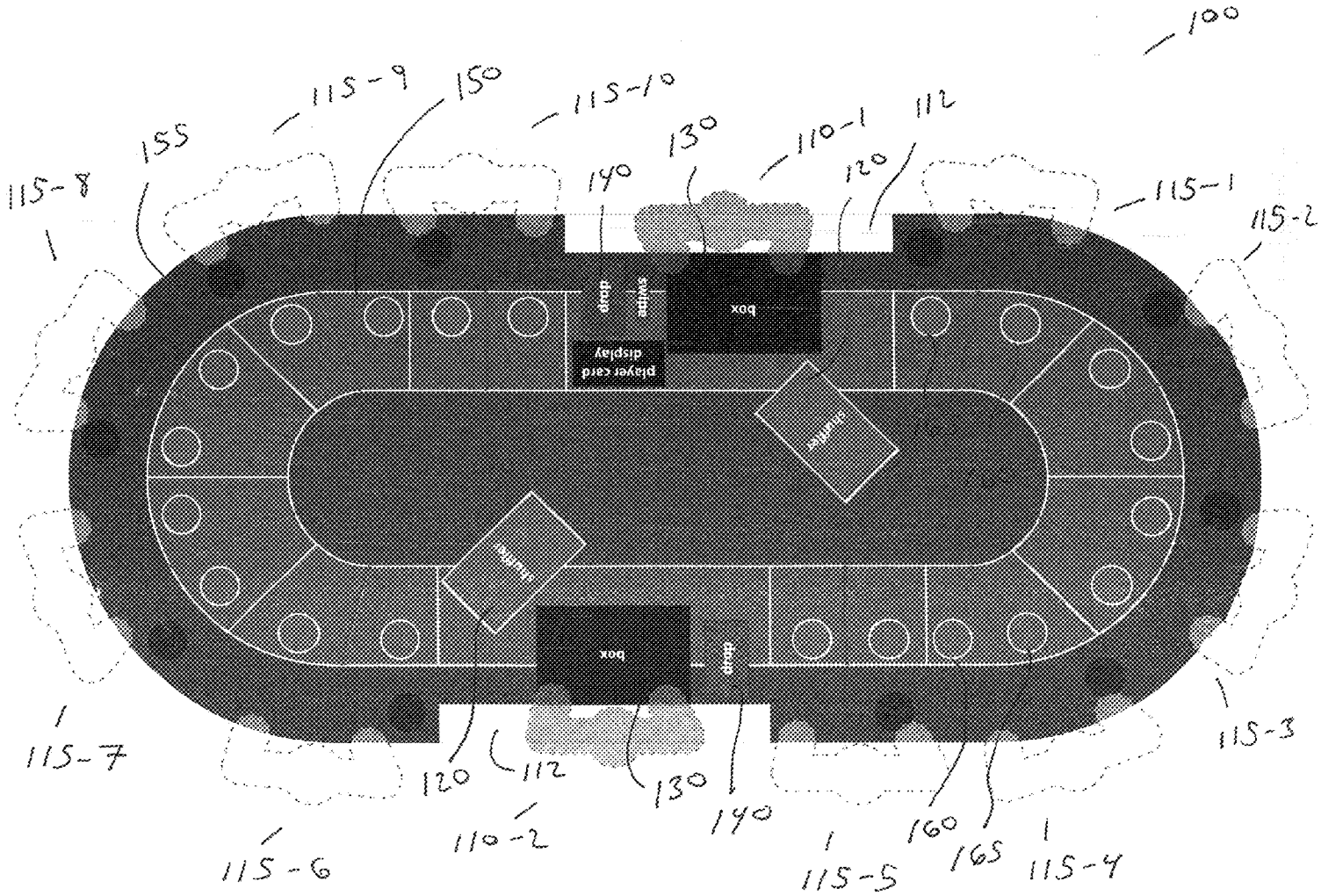
FIG. 1 illustrates an overhead view of a poker table of the type to facilitate the play of a poker game according to the embodiments of the present invention.

For the purposes of promoting an understanding of the principles in accordance with the embodiments of the present invention, reference will now be made to the embodiments illustrated in the drawings and specific language will be used to describe the same. It will nevertheless be understood that no limitation of the scope of the invention is thereby intended. Any alterations and further modifications of the inventive feature illustrated herein, and any additional applications of the principles of the invention as illustrated herein, which would normally occur to one skilled in the relevant art and having possession of this disclosure, are to be considered within the scope of the invention claimed.

The embodiments of the present invention utilize conventional decks of 52 cards comprising suits of spades, hearts, diamonds and clubs and 13 ranks comprising 2-10, Jacks, Queens, Kings and Aces. Jokers may also be used. It is conceivable that other card types and combinations may be used as well.

FIG. 1 shows an overhead view of a poker table 100 of the type which may be used to facilitate a poker game according to the embodiments of the present invention. As shown, the poker table 100 is elliptical in shape but those skilled in the art will recognize that other shapes are possible (e.g., circular and square). The poker table 100 incorporates a pair of dealer stations 110-1 and 110-2 and accommodates ten players at ten player stations 115-1 through 115-10. More or less players may be accommodated by the poker table 100 or any other table. Depending on the embodiment, each dealer station 110-1 and 110-2 may include an automatic card shuffler 120, chip rack 130 and drop box 140. In one embodiment, as shown in FIG. 1, the dealer stations 110-1 and 110-2 are positioned oppositely on long sides of the poker table 100 in an offset relationship. Other dealer station positions are possible without departing from the scope and spirit of the embodiments of the present invention. Each dealer station 110-1 and 110-2 is defined by a cut-out area 112. Two dealer stations 110-1 and 110-2 permit each dealer to deal poker hands which are played substantially simultaneously on the poker table 100. While two dealer stations 110-1 and 110-2 are shown, more than two dealer stations are conceivable. A padded railing 155 circumscribes the poker table 100 in a conventional fashion.

Figure 2:
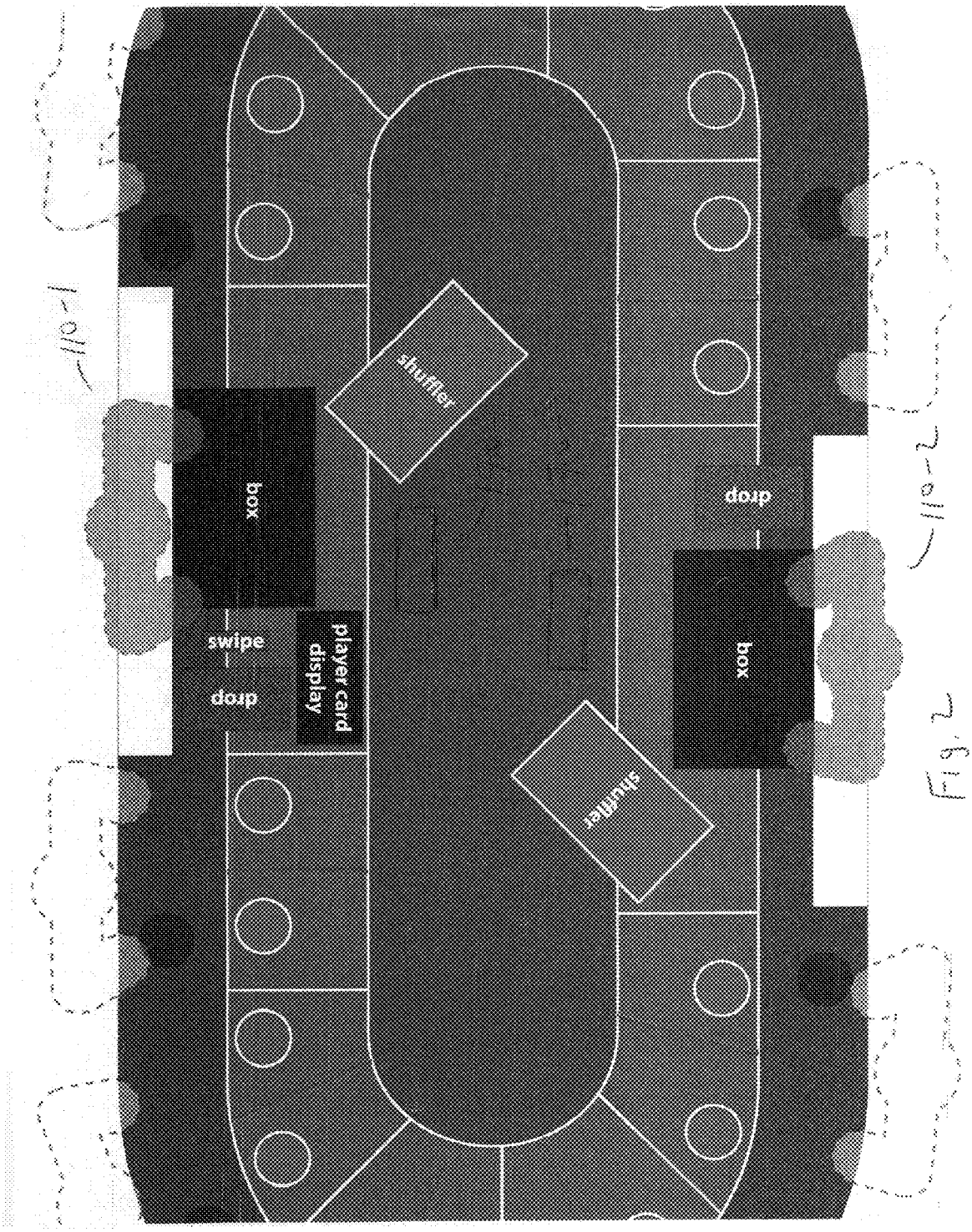
FIG. 2 illustrates an overhead view of the poker table of FIG. 1 with distinct common card areas proximate the dealer stations according to the embodiments of the present invention.

A poker table layout 150 depicts two chip areas 160, 165 at each player station 115-1 through 115-10. The two chip areas 160, 165 may be colored differently or otherwise distinguished from one another to allow players to segregate chips from the independent poker hands. FIG. 2 shows the poker table 100 of FIG. 1 with distinct common card areas 170-1 and 170-2 proximate the dealer stations 110-1 and 110-2, respectively. The common card areas 170-1 and 170-2 may be defined by different colored borders or otherwise distinguished.

As detailed above, the poker table 100 facilitates the play of independent poker hands substantially simultaneously at the same table. The play of independent poker hands substantially simultaneously satisfies the need for "action" by many players, especially younger players seeking an increased pace and level of stimulation. In addition, the house benefits from additional poker table revenue (i.e., the house collects more in rakes and/or entry fees), which may be greater than twice normal poker table revenues, without raising overhead significantly. Indeed, the only true increase in overhead relates to the fixed costs associated with acquiring the novel poker tables and ongoing expense of an additional dealer both of which are quickly minimized by the increase in revenue.

Figure 3A:
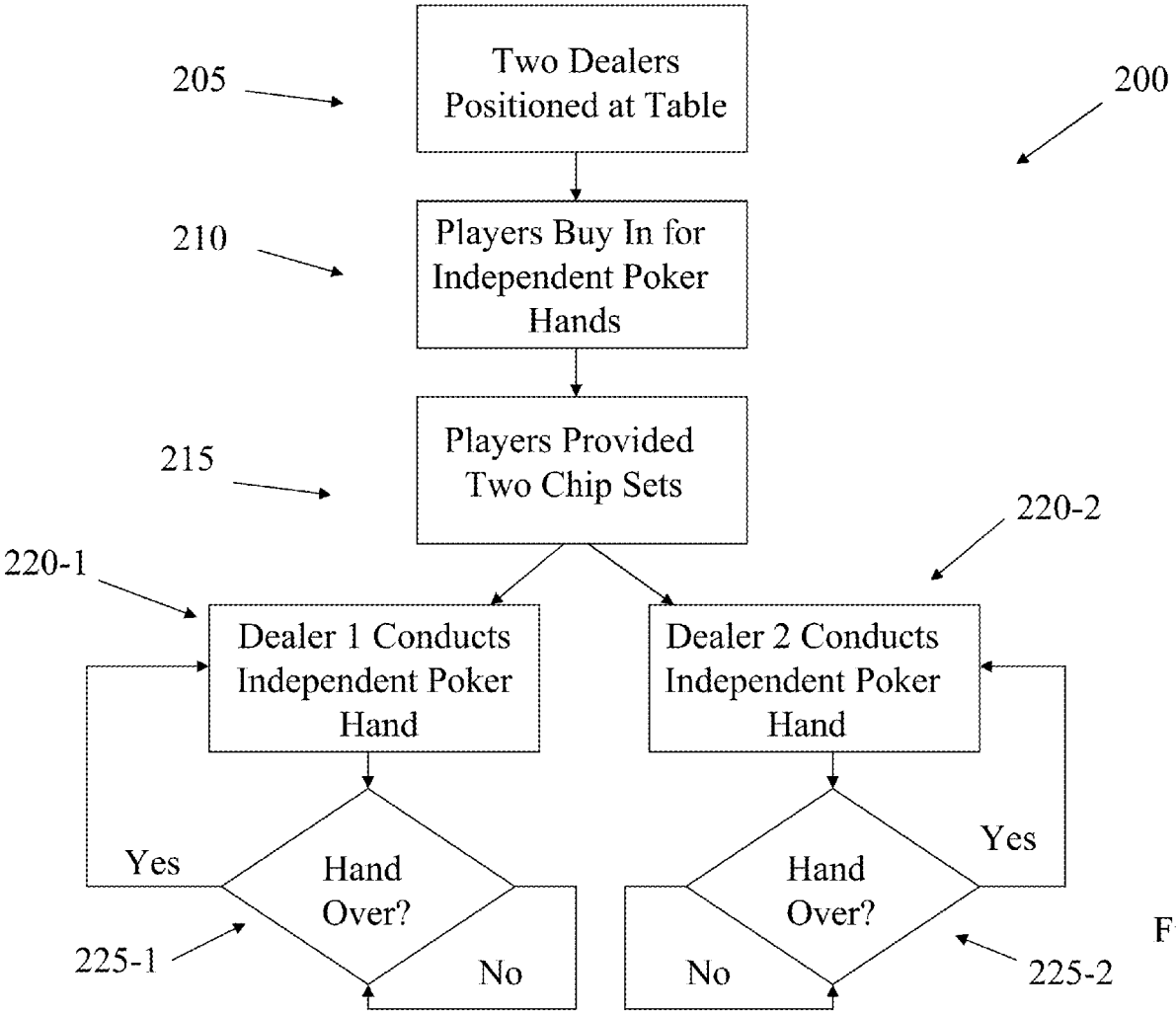
FIGS. 3*a* and 3*b* illustrate flow charts detailing alternative methods of conducting a poker game according to the embodiments of the present invention.
Figure 4A:
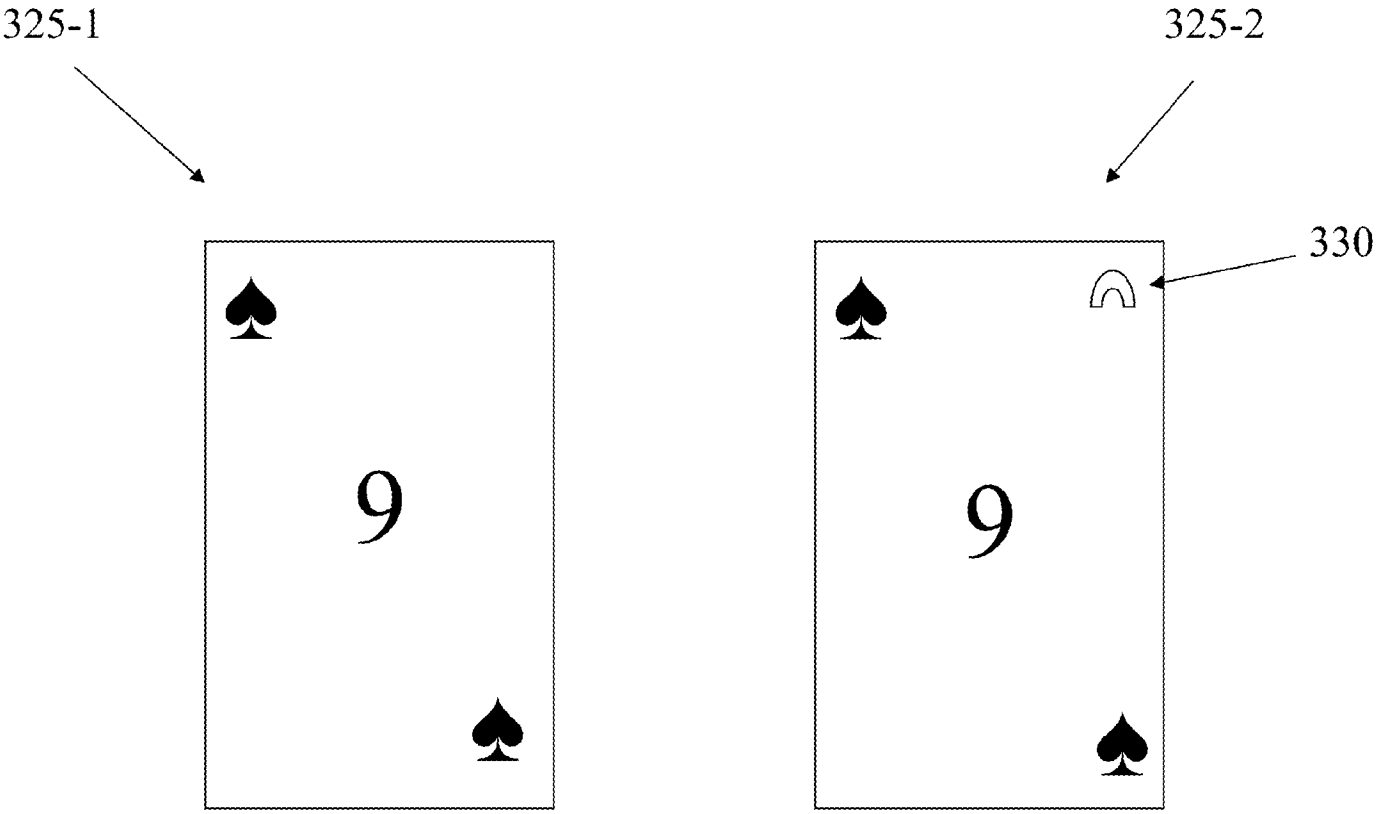
FIGS. 4*a* and 4*b* illustrate a first and second poker cards from independent decks of poker cards according to the embodiments of the present invention.
Figure 4B:
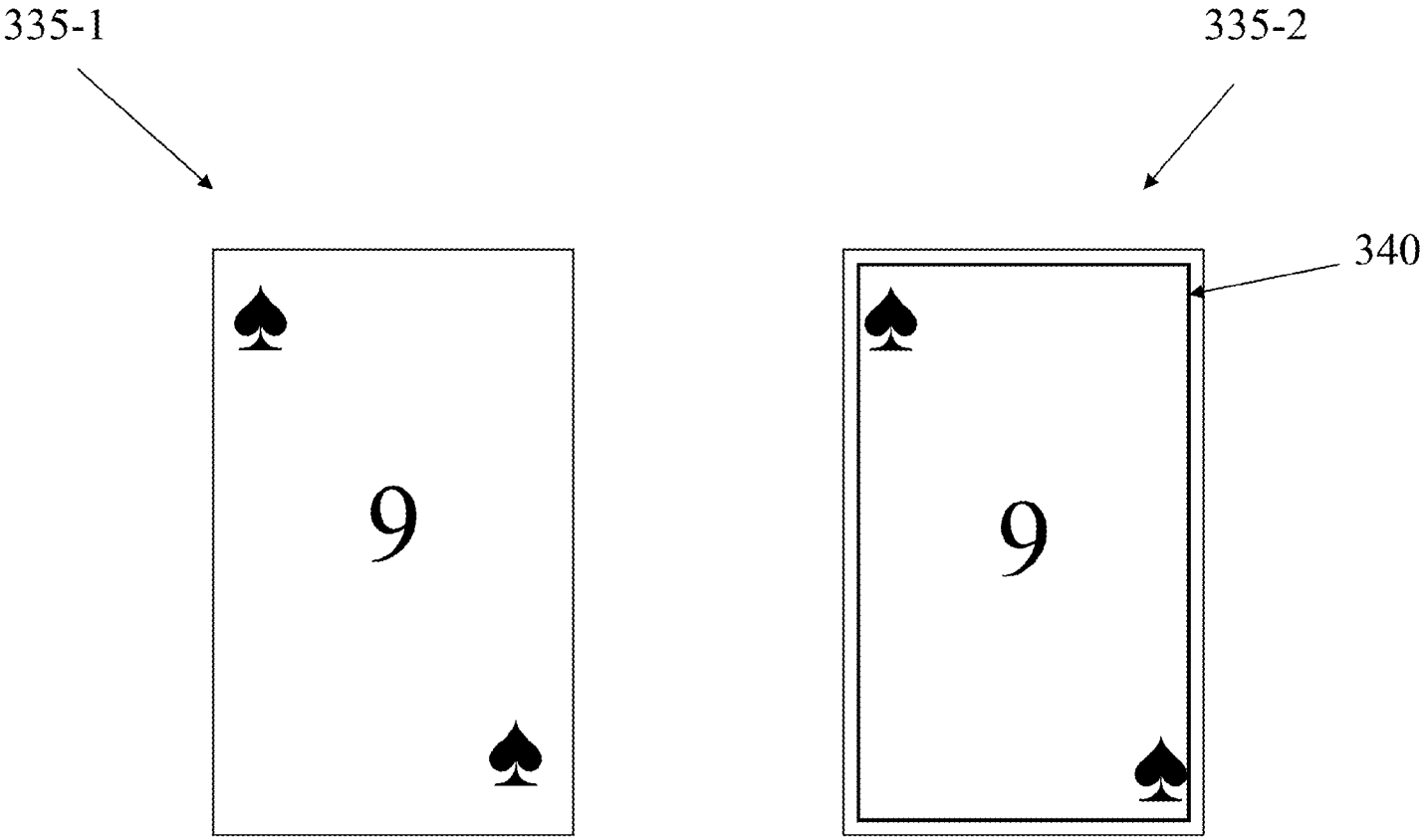

FIG. 3*a* shows a flow chart 200 detailing a first method of conducting the poker game according to the embodiments of the present invention. At 205, two dealers are positioned at respective, independent dealer stations. At 210, players buy in to play the independent hands of poker. At 215, players are provided with distinctive poker chips for each hand. For example, a first poker hand may use blue, red, green and black chips while the second poker hand may use yellow, orange, pink and purple chips. Other chip distinctions include different cross-hatch patterns, color combinations, and sizes. Well-known RFID technology may also be used to prevent inadvertent or purposeful co-mingling of the different poker chips. Lighted chips and unlighted chips may also be used to distinguish between the independent poker hands as well. The poker cards may also be distinguished to keep them from inadvertent or purposeful co-mingling. In one embodiment, the backs of the two independent decks of poker cards have different colors and/or patterns. However, as the front of the poker cards are often being shown, it may also be desirable to distinguish the front of the poker cards from each deck of poker cards. This may be accomplished subtly using a number, color tint, symbol, pattern or other indication on the face of the poker cards from one of the decks of poker cards. FIG. 4*a* shows a first poker card 325-1 from a first deck of poker cards and the same poker card 325-2 from a second deck of poker cards. The symbol 330 in the upper right hand corner is on each card 325-2 of the second deck of poker cards. Alternatively, one deck of poker cards may have a border on the face of the poker cards while the faces of the poker cards from the other deck do not. FIG. 4*b* shows a first poker card 335-1 from a first deck of poker cards and the same poker card 335-2 from a second deck of poker cards with the border 340. At 220-1, 220-1, the dealers each conduct their independent poker hands using the independent (i) automatic card shufflers; (ii) chip racks and chips; (iii) poker cards; and/or (iv) drop boxes. Accordingly, each dealer manages wagers and a game pot from each set of independent poker hands and maintains a separation of the chips and pot from the other poker hand set being played substantially simultaneously. At 225-1, 225-2, it is determined if either poker hand has ended, if so, the chart loops back to 225-1, 225-2, respectively, for the dealer of the ended hand to deal another hand. Thus, players are playing independent poker hands substantially simultaneously as each dealer deals his or her poker hands without concern for the progress of the other poker hand—that is, each poker hand in literally independent and each dealer may deal a varied number of hands over a gaming session.

Figure 3B:
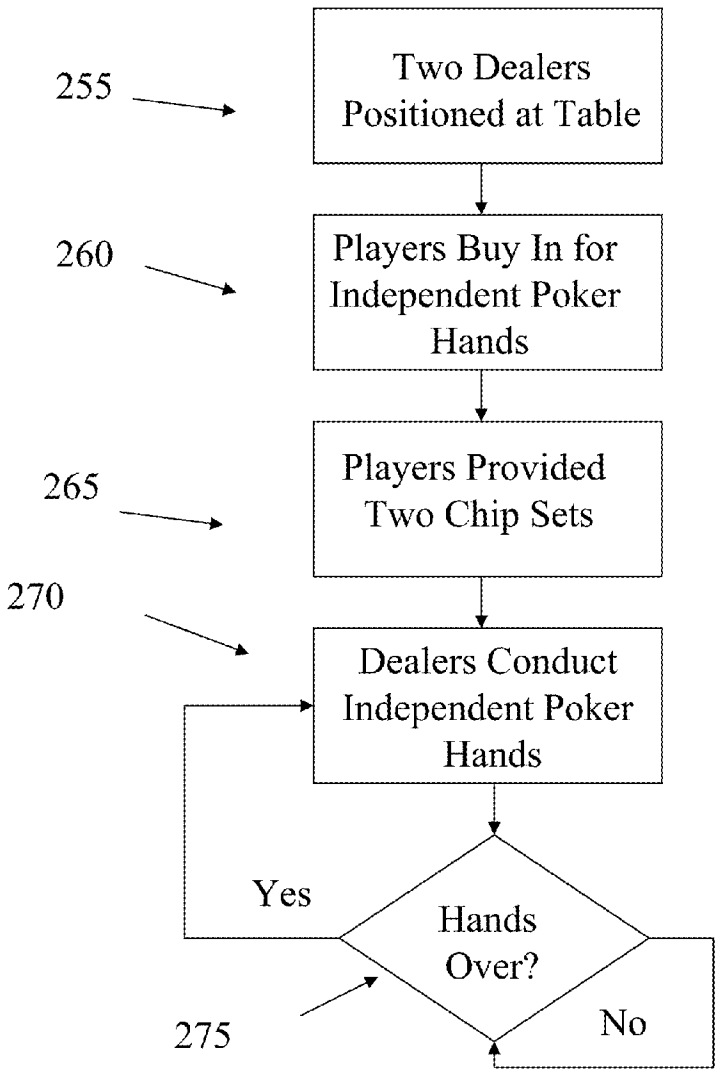

FIG. 3*b* shows a flow chart 250 detailing a second method of conducting a poker game according to the embodiments of the present invention. At 255, two dealers are positioned at respective, independent dealer stations. At 260, players buy in to play the independent hands of poker. At 265, players are provided with distinctive poker chips for each hand. At 270, the dealers each conduct their independent poker hands using the independent (i) automatic card shufflers; (ii) chip racks and chips; (iii) poker cards; and/or (iv) drop boxes. At 275, it is determined if both hands are over. If so, the chart loops back to 270 for the dealers to each deal the next hand at the same time. In this alternative embodiment, the dealers both finish their respective poker hand before either dealer deals the next hand. Thus, each dealer deals the same number of hands over a gaming session such that again the players are playing poker hands substantially simultaneously.

The simultaneous poker hands may be directed to cash games or tournaments. Indeed, the simultaneous poker hands may lend themselves to interesting tournament scenarios which incorporate success of players in both poker hands substantially simultaneously. Any number of poker hands, including Texas Hold'em, Omaha and Seven Card Stud, may be played substantially simultaneously according to the embodiments of the present invention. Indeed, different two poker hands (e.g., Texas Holde'em and Omaha) may be played substantially simultaneously, and the direction of play may be varied.

Although the invention has been described in detail with reference to several embodiments, additional variations and modifications exist within the scope and spirit of the invention as described and defined in the following claims.

I claim:

1. A method of conducting a poker game comprising:

positioning two dealers about a poker table at two independent dealer stations, each dealer station including one or more of each of the following:

(i) automatic card shuffler;

(ii) chip rack and chips;

(iii) poker cards; and (iv) drop box;

causing said two dealers to utilize said one or more automatic card shufflers to randomly shuffle said poker cards from two independent, distinguishable decks of cards prior to play of each new poker hand;

utilizing said two dealers to deal two independent poker games to players at the poker table from said two independent, distinguishable decks of cards; and providing poker players with two distinguishable poker chip sets to play said two independent poker games simultaneously whereby a first distinguishable poker chip set is only useable in one of said two poker games and a second poker chip set is useable only for the other of said two poker games, each of said two independent poker games played at its own pace without regard to the pace of the other poker game whereby a first dealer begins a new poker hand when a previous poker hand managed by said first dealer ends regardless of the state of the other poker hand being conducted by the second dealer and vice versa.

2. The of method conducting a poker game according to claim 1 further comprising utilizing a poker table layout depicting two distinctive chip placement areas designated for chips of said independent poker hands.

3. The method of conducting a poker game according to claim 1 further comprising a poker table having an elliptical shape.

4. The method of conducting a poker game according to claim 3 further comprising positioning two dealer stations oppositely along long sides of the poker table.

5. The method of conducting a poker game according to claim 1 further comprising utilizing a poker table layout depicting two distinguishable common card areas.

6. The method of conducting a poker game according to claim 1 further comprising utilizing two decks of distinguishable cards.

7. A method of conducting a poker game comprising:

positioning two dealers about a poker table at two independent dealer stations, each dealer station including one or more of each of the following:

(i) automatic card shuffler;

(ii) chip rack and chips;

(iii) poker cards; and (iv) drop box;

instructing said two dealers to utilize said one or more automatic card shufflers to randomly shuffle said poker cards from two independent, distinguishable decks of cards prior to play of each poker hand;

instructing each dealer to deal cards from said two independent, distinguishable decks of cards in a manner representative of the poker game being played such that each player plays two sets of cards attributable to two independent poker games;

instructing said two dealers to manage wagers from said two independent poker games; and providing each player with two distinguishable chip sets to play said two independent poker games simultaneously whereby a first distinguishable poker chip set is only useable in one of said two poker games and a second poker chip set is useable only for the other of said two poker games, each of said two independent poker games played at its own pace without regard to the pace of the other poker game whereby a first dealer begins a new poker hand when a previous poker hand managed by said first dealer ends regardless of the state of the other poker hand being conducted by the second dealer and vice versa.

8. The of method conducting a poker game according to claim 7 further comprising utilizing a poker table layout depicting two distinctive chip placement areas designated for chips of said independent poker hands.

9. The method of conducting a poker game according to claim 7 further comprising a poker table having an elliptical shape.

10. The method of conducting a poker game according to claim 9 further comprising positioning two dealer stations oppositely along long sides of the poker table.

11. The method of conducting a poker game according to claim 7 further comprising utilizing a poker table layout depicting two distinguishable common card areas.

12. The method of conducting a poker game according to claim 7 further comprising utilizing two decks of distinguishable cards.

13. A method of conducting a poker game comprising:

utilizing two dealers at a poker table to deal and manage two independent poker games simultaneously, said two dealers using independent and distinguishable:

(i) poker cards; and (ii) poker chips; and wherein said two dealers (i) utilize automatic card shufflers to randomly shuffle said poker cards from two independent, distinguishable decks of cards prior to play of each poker hand; (ii) deal cards from said two independent, distinguishable decks of cards in a manner representative of the poker game being played such that each player plays two sets of cards attributable to two independent poker games; and (iii) providing each player with two distinguishable chip sets to play said independent poker games simultaneously whereby a first distinguishable poker chip set is only useable in one of said two poker games and a second poker chip set is useable only for the other of said two poker games, each of said two independent poker games played at its own pace without regard to the pace of the other poker game whereby a first dealer begins a new poker hand when a previous poker hand managed by said first dealer ends regardless of the state of the other poker hand being conducted by the second dealer and vice versa.

14. The method of claim 13 further comprising using poker cards distinguishable on backs and faces.

* * * * *